US006983592B2

(12) United States Patent
Bruun

(10) Patent No.: US 6,983,592 B2
(45) Date of Patent: Jan. 10, 2006

(54) MOBILE WORKING MACHINE

(76) Inventor: Lars Bruun, Piludden, SE-682 34 Filipstad (SE)

( * ) Notice: Subject to any disclaimer, the term of this patent is extended or adjusted under 35 U.S.C. 154(b) by 78 days.

(21) Appl. No.: 10/477,995

(22) PCT Filed: May 8, 2002

(86) PCT No.: PCT/SE02/00880

§ 371 (c)(1),
(2), (4) Date: Nov. 17, 2003

(87) PCT Pub. No.: WO02/095243

PCT Pub. Date: Nov. 28, 2002

(65) Prior Publication Data

US 2004/0159101 A1 Aug. 19, 2004

(30) Foreign Application Priority Data

May 22, 2001 (SE) ..... 0101839

(51) Int. Cl.
*F16D 31/02* (2006.01)

(52) U.S. Cl. ..... 60/415; 418/478

(58) Field of Classification Search ..... 91/4 R, 91/4 A; 60/479, 478, 418, 415, 329, 328
See application file for complete search history.

(56) References Cited

U.S. PATENT DOCUMENTS 3,762,165 A * 10/1973 Takenoshita et al. ..... 60/479
4,715,180 A * 12/1987 Rosman ..... 60/372
4,781,061 A * 11/1988 Baumgartl ..... 73/149
6,584,769 B1 * 7/2003 Bruun ..... 60/414
6,804,957 B2 * 10/2004 Bruun ..... 60/414

FOREIGN PATENT DOCUMENTS

| | | |
|---|---|---|
| DE | 197 21 759 | 11/1998 |
| WO | WO 96/13669 | 5/1996 |
| WO | WO 00/00748 | 1/2000 |

OTHER PUBLICATIONS

Copy of International Search Report.

* cited by examiner

*Primary Examiner*—Edward K. Look
*Assistant Examiner*—Michael Leslie
(74) *Attorney, Agent, or Firm*—Michael Bednarek; Pillsbury Winthrop Shaw Pittman LLP

(57) ABSTRACT

The present invention relates to a mobile handling arrangement with hydraulic circuit, forming part of which hydraulic part of which hydraulic circuit (L) is a lifting cylinder (1) arranged in a lifting arrangement (100) made for handling a variable load together with an accumulator arrangement (6) for recovering and reusing the lowered load energy, the hydraulic circuit also comprising a variable hydraulic machine (3) having two ports (10, 11), the said hydraulic machine being capable, by way of a drive unit (D), of delivering full system pressure in two directions of flow to the said ports, one port (11) being connected to the said accumulator arrangement (6) and the other port being connected to the said lifting cylinder (1), characterized in that the hydraulic circuit (L) comprises a temperature sensor (95) in connection with a gaseous phase part (68B) of the said accumulator arrangement (6) and a control and feedback unit (94) in communication with the said temperature sensor (95), by means of which the filling level in the said accumulator arrangement (6) is adjusted as a function of the temperature in the said gaseous phase part (68B).

10 Claims, 1 Drawing Sheet

MOBILE WORKING MACHINE

TECHNICAL FIELD

The present invention relates to a mobile handling arrangement with hydraulic circuit, forming part of which hydraulic circuit is a lifting cylinder arranged in a lifting arrangement made for handling a variable load together with an accumulator arrangement for recovering and reusing the lowered load energy, the hydraulic circuit also comprising a variable hydraulic machine having two ports, the said hydraulic machine being capable, by way of a drive unit, of delivering full system pressure in two directions of flow to the said ports, one port being connected to the said accumulator arrangement and the other port being connected to the said lifting cylinder.

DESCRIPTION OF THE PRIOR ART AND PROBLEM

Excavators, trucks, container handlers etc. and a large number of other mobile handling machines made to handle variable loads have one or more lifting cylinders in order to lift the load for which the unit is designed. By far the majority of mobile handling arrangements in use today have no form whatsoever of energy recovery for the lowered load, which means that the lowered load energy, very often in the passage through an operating valve that determines the lifting and lowering movement, is converted into heat which then has to be dissipated.

PCT/SE99/01131 discloses a mobile handling arrangement with hydraulic circuit, forming part of which is an accumulator system, by means of which a large amount of energy can be recovered from the lowered load. The system has proved capable of yielding energy savings of almost 50% in particularly favourable instances.

In certain situations, however, operation may be rendered more difficult if the temperature at which the mobile handling arrangement must operate varies over too great a range. The problem is particularly marked if the accumulator is arranged with one or more external vessels for the gaseous phase. The problem stems from the fact that the gas which creates back-pressure inside the accumulator is temperature-dependent, which is generally known through Bernouilli's law, that is $pV=RT$. Thus in certain situations pressure changes, which occur due to changes in ambient temperature, may create problems for the operation of such a mobile handling arrangement.

SUMMARY OF THE INVENTION

An object of the invention is to eliminate or at least minimise the aforementioned disadvantages, which is achieved by a method in a mobile handling arrangement according to the characterising part of claim 1.

By means of the invention the accumulator arrangement is automatically adjusted to the ambient temperature, which ensures that a desired operation of the system can be guaranteed irrespective of the ambient temperature.

BRIEF DESCRIPTION OF THE DRAWINGS

The invention will be explained in more detail below with reference to the drawings attached, in which a hydraulic circuit according to the invention is shown in diagrammatic form.

DETAILED DESCRIPTION

Figure 1:
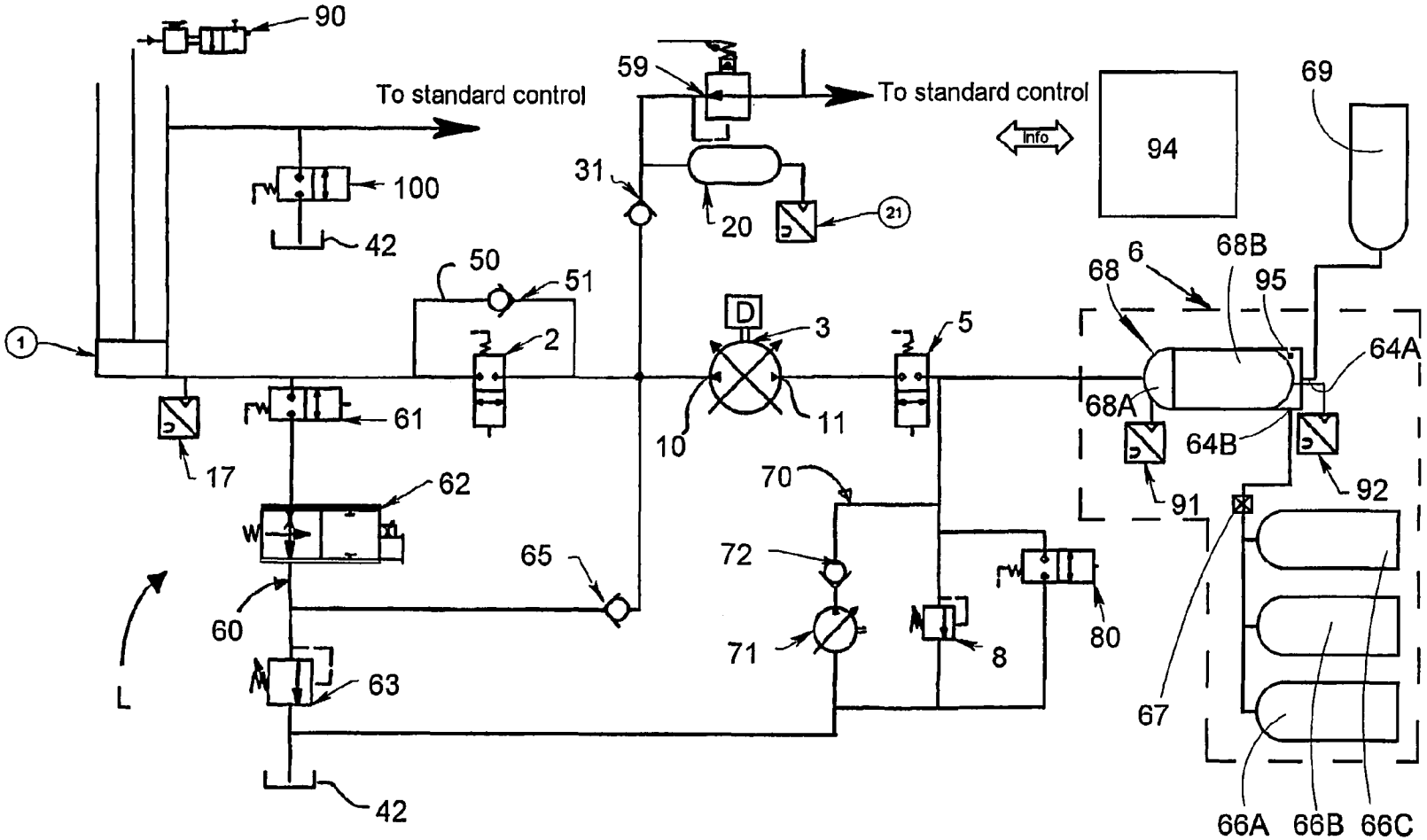

FIG. 1 shows a hydraulics diagram for a lifting cylinder in a hydraulic circuit, which substantially corresponds to what is shown in PCT/SE00/02360 and is supplemented in accordance with the invention A double-acting hydraulic cylinder 1, a variable piston pump 3 (hereinafter referred to as hydraulic machine) and an accumulator arrangement 6, which will be described in more detail below, are shown. The hydraulic circuit is arranged in a mobile handling arrangement, such as a truck or excavator, the lifting cylinder 1 therefore being designed to perform vertical work in the lifting arrangement of the handling arrangement, for example the arm which supports the shovel on an excavator. Arranged between the lifting cylinder 1 and the hydraulic machine 3 is a logic element 2 in the form of a shut-off valve, which is spring-loaded and which in its inactivated condition interrupts the connection between hydraulic machine 3 and lifting cylinder 1. In its activated position the valve arrangement 2 opens the connection between the hydraulic machine 3 and the lifting cylinder 1. This logic element 2 also preferably functions as hose break element. A similar logic element 5 is arranged between the accumulator arrangement 6 and the hydraulic motor 3, with a similar function to the first aforementioned logic element 2. This, too, is in the form of a shut-off valve 2. The hydraulic machine is operated in a manner known in the art via a suitable transmission, and preferably by means of a fuel-powered engine D.

The hydraulic machine 3 is a variable piston pump which can both take in and deliver oil to the ports 10, 11. The pump is of a type known in the art, which permits full system pressure at both of the outlet ports and in which the flow can be adjusted from 0 to max by means of the variable adjustment setting, as is usually achieved by means of a so-called swashplate. The use of such a pump eliminates the need to control the circuit by way of an operating valve, thereby achieving a considerable simplification and reducing control losses.

A safety valve 8 is arranged in the system between the accumulator arrangement 6 and a tank 42, which ensures that a certain maximum circuit pressure is not exceeded.

A pressure-sensing element 17 is designed to register the pressure in the line between the lifting cylinder 1 and the logic element 2. In a lowering movement requiring power, the pressure-sensing element 17 will register the fact that the pressure is below that needed for the function and will ensure that oil is supplied to the rod side of the lifting cylinder. The function of the pressure-sensing element 17, therefore, is to ensure that the hydraulic machine 3 reduces the flow to 0 when the hydraulic cylinder no longer has any pressure, for example when the shovel has reached ground-level.

The system functions on the principle that in a lifting movement the driver will transmit an operating signal, which will ensure that the valves 2 and 5 open. The connection between accumulator arrangement 6, hydraulic machine 3 and lifting cylinder 1 is thereby fully open. The pressurised oil in the accumulator arrangement 6 then flows to the variable hydraulic machine 3, which passes the oil on to the lifting cylinder 1. If the pressure in the accumulator is then higher than is needed to perform the work with the lifting cylinder 1, the excess energy can be delivered to the drive system through that of the hydraulic machine 3. Should the accumulator pressure not be entirely sufficient, the variable hydraulic machine 3 delivers a pressure boost in order to attain the necessary pressure level, which is produced by means of power supplied via the engine D of the handling machine. In such a situation therefore, only as much energy is supplied as is needed to overcome the pressure differential between the accumulator and the lifting cylinder demand. In a lowering movement the direction of flow in the pump is reversed and oil is supplied to port 10 and delivered at port 11, in order to supply the accumulator arrangement 6. If the pressure in the accumulator arrangement 6 is then lower than in the lifting cylinder 1, the variable hydraulic machine 3 will be capable of supplying energy. If, on the other hand, the pressure in the accumulator is higher than in the lifting cylinder, excess energy from the engine D will need to be supplied to the variable hydraulic machine 3 in order to obtain a lowering movement. This energy supplied is, however, stored in the accumulator arrangement 6 and is therefore available for the next lifting movement. It will be apparent from the aforementioned that the system is energy-saving and eliminates heat-generating restriction of the oil flow, which normally occurs where the lowered load energy is managed in conventional systems.

Also shown is a proportional valve 62, which allows small lowering movements to be performed without involving the hydraulic machine 3 and which moreover increases the capacity of the lowering movement when the hydraulic machine reaches its maximum capacity. The system is furthermore monitored by a feedback and control system 94, hereinafter called a computer system 94, which suitably receives information from sensors, including pressure sensors 91 and 92, position sensor 90 and engine speed sensor. The accumulator circuit is therefore provided with pressure sensors 91, 92 both on the oil side 68A and on the gas side 68B, with the object of being able to optimise the process of charging the accumulator arrangement 6 by means of the pump 71. The valve 80 also has an important function in connection with this. That is to say, when starting up the valve 80 is opened so that the oil side in the accumulator is drained to the tank 42, allowing the gas pressure to be monitored and registered by the computer 94, which in turn allows the minimum displacement of the hydraulic machine 3 to be regulated before the accumulator arrangement 6 is completely emptied. By means of the position sensor 90 it is possible to register how much of the stroke of the lifting cylinder 1 is being utilised. This can be used, among other things, to increase the efficiency if the computer detects that the lifting cylinder, during a repetitive sequence, has not made use of more than a limited part of the stroke, the computer system 94 then being able to transmit a signal to the pump to increase the pressure level, which can provide the said improvement in efficiency.

When lowering the lifting cylinder, the greater part of the oil will be pumped to the accumulator system 6, but when the arm system is suddenly relieved, when the shovel meets the ground, for example, a pressure sensor in the lifting circuit must send a signal to the computer to reduce the pump capacity. During the hydraulic machine response time it must be supplied with oil to prevent its being damaged (split), and this quantity is obtained from the refilling circuit, which comprises the accumulator 20, the non-return valve 31 and the pressure reducer 59, which obtains its oil from the open circuit of the machine.

The hydraulic machine chosen for the system has, like all rotary pumps, a volumetric loss, which at full flow and pressure can be put at 5%, but which in the case of small flows may be almost 100%, and this loss of fluid must be replaced. It is important to realise that this loss is virtually unaffected by the angling or flow of the hydraulic machine 3. In a lowering movement, therefore, not all the quantity of oil delivered by the lifting cylinder will be recovered in the accumulator arrangement 6, but rather a proportion will pass to the tank 42 via the leakage line of the hydraulic machine. In addition to this leakage, account must also be taken of the quantity that is drained via the valve 62. It must be possible to control the lowering movement of a lifting machine with great accuracy and the hydraulic machine 3 does not provide sufficient accuracy in this respect For this reason the lowering circuit contains a valve 62, which permits full control. A lowering movement will be performed solely via the valve 62 if small movements or great accuracy is required.

The hydraulic machine 3 is designed to permit full lifting speed, but it becomes considerably more expensive to design the hydraulic machine to also cope with a full lowering speed which is approximately 50% higher, that is to say which would require a flow approximately 50% greater. Furthermore, this would also result in a considerable increase in the areas of piping etc. The valve 62 therefore has two functions, firstly to permit full control in the case of low lowering speeds and secondly to increase the maximum lowering speed in the case of high lowering speeds. Or to put it another way, the valve 62 allows a hydraulic machine 3 of relatively small capacity to be used. The computer 94 is responsible for this feedback control sequential control.

The problem that arises in filling the accumulator arrangement 6 with oil in order to ensure the next lifting movement is solved as follows. The lifting piston 1 is provided with a position sensor 90, which sends a signal to the computer 94, which also receives a signal from the accumulator system 6 via the sensor 91. The computer 94 then calculates the demand and sends a signal to the pump 71, which ensures that the required/adequate pressure is generated in the accumulator arrangement 6, which in turn determines the quantity in the accumulator. This refilling of the accumulator therefore occurs regardless of whether a lowering movement or lifting movement is taking place, or whether other functions are in use. The capacity of the pump 71, therefore, need only be a fraction of the capacity of the hydraulic machine. The reason for this is that the said refilling of the accumulator occurs throughout the time that the machine is in use.

In order to appreciate the advantage of the invention, the following should be taken into consideration.

1. The engine power output of an excavator or other lifting machine is largely determined by the lifting movement.
2. The fuel consumption of a diesel engine is to a large extent determined by the maximum power output. Since the power output must be immediately available in a lifting movement, any prolonged hunting that occurs when lifting is unacceptable. The fuel consumption of a diesel engine depends more on the engine speed and size than on the power drawn. The fuel consumption figures quoted are always related to the optimum speed for the power drawn. Idling consumption rises dramatically with increasing revolutions. In the measurements carried out, the consumption increases by more than 500% from low idling speed to racing speed. At full working revolutions normally used on an excavator, the fuel consumption is between 30 and 50% of maximum consumption when no power is being taken off. Since the invention permits an engine reduction of at least 30% without sacrificing the capacity, it will be appreciated that a significant fuel saving can occur.

A major advantage is achieved by the use of the separate valve 62 to control the lowering speed, which permits full control, and by the fact that the same valve can be used to obtain full lowering speed. Owing to the inevitable volumetric losses that occur in a hydraulic machine that is pressurised, the lowering movement will mean that an increase signal has to be sent to the hydraulic machine when low lowering speeds are required Since the hydraulic machine is not pressure-compensated, moreover, the lowering speed will be load-dependent, which is unacceptable from an operating standpoint. When low lowering speeds are required, therefore, the computer does not send a signal to the hydraulic machine 3 or to the valves 2 and 6, but only to the valves 61 and 62. In this way a precisely controlled movement is obtained with immediate response. It may be pointed out in this context that the control times on such a hydraulic machine 3 are normally perceived as being too long. When a higher lowering speed is required, the computer sends a signal to the valves 2 and 5 to open at the same time that the hydraulic machine 3 is shifted to full output. When full output on the hydraulic machine 3 has been reached, the computer sends a signal to the valve 62 to increase the flow to the required level. The maximum flow via the valve is 50% of the pump capacity.

The overflow valve 63 is designed to permit pressurisation of the hydraulic machine 3 before the valves 2 and 5 are opened, so that a "dip" in the lowering is avoided. The non-return valve 51 is designed to prevent the occurrence of a "dip" during lifting. The nonreturn valves 65 and 31 prevent unwanted flows.

The computer-controlled control system 94 preferably includes an optimised power output function, which is based on the principle that when no power is being drawn, the speed will settle at the racing speed for the given power conditions. It is known from experience that the engine is fully loaded when the speed has fallen by x %. When the engine has a load level less than a given value, for example 80%, the computer sends a signal to the pump 71 to increase the pressure level in the accumulator system 6 by an appropriate percentage (e.g. 5–20%, suitably approximately 10%) to the minimum level that is needed in order to meet the lifting demand. This superimposed energy will furthermore permit a power reduction in the subsequent lifting work. Also suitably included in the computer controlled program for boosting the pressure in the accumulator system 6 is an adaptive function, which will mean that the system adjusts the accumulator charging pressure to the level that the lifting cylinder assumed in a freely selected number of previous lowering operations. The accumulator system is designed and calculated to allow the quantity of oil present in the lifting cylinder to be accommodated in the system. The working area of an excavator is calculated and designed to cover a considerably larger area than the machine is generally used for. Normally, no more than 60–70% of the lifting cylinder stroke is utilised, but in calculating the size of the accumulator it is necessary to calculate the maximum quantity of oil that can be taken in by the accumulators. In order not to end up with extremely large and expensive accumulators, the gas pressure must often be reduced to an ideal level, in order that the final pressure will not be too high when the lifting cylinder is in its bottom position. The adaptive function ensures that a pressure increase occurs when the system receives information that only a limited proportion of the lifting cylinder stroke is being utilised. The overflow valve 22 ensues that the pressure does not exceed that which is permitted, should a driving pattern emerge that has not arisen previously.

It can also be seen from FIG. 1 that the accumulator arrangement 6 comprises a main accumulator 68, inside which is an oil phase 68A and a gaseous phase 68B, which are divided in a known manner by means of a moveable partition wall inside the main accumulator 68. A connection 64A is arranged in the main accumulator 68. Gas can be introduced into the main accumulator 68 through this connection 64A According to a preferred embodiment, a connection 64B is furthermore assigned to the accumulator 68, via which the accumulator 68 is connected to one or more (in this case three) gas cylinders 66A–C, which supplement the accumulator 68 in order to obtain a sufficiently large total gas volume. According to a preferred embodiment the proportions in the accumulator arrangement 6 should be such that at maximum filling level, that is to say at the desired excess pressure inside the accumulator arrangement, the quantity of oil represents approximately 70–80% of the total volume, so that the volume of gas in the arrangement is then between 20 and 30%. The arrangement with a plurality of gas cylinders 66A–C provides an essentially less expensive arrangement, since the cost of a gas cylinder (available from a standard commercial range) of a certain volume is significantly lower than that of providing a corresponding volume inside the actual main accumulator 68. Also shown is a shut-off element 67, arranged in the line between the gas cylinders 66A–C and the connection 64B.

As already stated in the introductory part of the description, temperature variations can lead to operating problems. It is not improbable for a particular mobile handling arrangement, such as an excavator shovel, in one case to work in extremely cold weather, in which the gas temperature may drop to −20° C., and for the same handling equipment in another case to work in an extremely hot environment, in which the gas temperature may rise to approximately +70° C. Temperature changes of almost 100° C. are therefore possible. As is generally known, this leads to great variations in the pressure of the gaseous phase in the accumulator arrangement 6. If the accumulator is calibrated for 120 bar at +20° C., for example, this means that the pressure at −20° C. will drop to 102 bar. If under such conditions the hydraulic pump 71 is allowed to work in the same way as at 20° C., the working pump 71 being pressure-controlled, this means that the accumulator will be filled with substantially more oil than is desirable, that is to say more than 70–80% before the 120 bar pressure level is reached, with the result that a certain proportion of the quantity of oil that is evacuated from the lifting cylinder in the lowering work is drained away without being recovered.

If, on the other hand, the same system operates under conditions in which the gas temperature is +70° C., this will lead to a nominal pressure increase to 148 bar at the required filling level. Under such conditions therefore, the pump 71 will not fill the accumulator arrangement 6 to the required level with the result that the necessary quantity of oil for the lifting cylinder will not be available in the accumulator arrangement 6.

According to a first alternative solution to the aforementioned problem, a temperature sensor 95 is used with connection to the gaseous phase 68B inside the main accumulator 68. By means of this temperature sensor 95 and a feedback and control unit 94, the hydraulic pump 71 can then be controlled so as to provide a charging pressure into the accumulator 68 that is adjusted to the gas temperature. The feedback and control unit 94 then registers and processes signals from the sensor 95 in order to first determine the optimum charging pressure as a function of the temperature in the gaseous phase 68B, and then to automatically actuate the hydraulic pump 71, in order to provide the required charging pressure into the main accumulator 68, that is to say approx. 112 bar (102 bar+10%) at a gas temperature of −20° C. if calibration has been performed at 120 bar (+20° C.). This solution ensures that the system functions reliably regardless of the ambient temperature.

According to a preferred method of refilling an arrangement according to FIG. 1, the main accumulator tank 68 is also used, with the aim of being able to discharge a top-up cylinder 69 regardless of the pressure attained in the gaseous phase 68B. A standard cylinder is suitably used, which has a filled pressure well in excess of the maximum charging pressure in the hydraulic pump 3. Gas cylinders (preferably nitrogen gas) with a filled pressure of at least 200 bar are preferably used. This is done in such a way that the accumulator arrangement 6 is first topped up with gas until the same pressure is obtained in the accumulator arrangement 6 as in the top-up cylinder 69. The tap 67 is then closed again. The pressure in the main accumulator 68 is then released and the accumulator filled up solely with gas, so that the greater part of its volume is taken up by the gas. In the next stage the tap 67 is opened again, following which the gas in the main accumulator 68 is forced into the gas cylinders 66A–C by means of the hydraulic pump 3. The gas is prevented from re-entering the top-up cylinder 69 by means of a non-return valve. This top-up procedure can then be repeated until the required quantity of gas has been pumped into the accumulator arrangement 6. It will be appreciated that this latter method is not limited to a system designed with automatic temperature control, but can advantageously also be used in all types of gas top-up for a similar accumulator system. The method in fact allows such an accumulator arrangement to be filled up using significantly fewer top-up cylinders than if a current method without the assistance of the hydraulic motor 3 were used, since then the last top-up cylinder can only top up with a very small proportion of the gas content, owing to the successively increasing back-pressure in the accumulator arrangement.

The invention is not limited by what has been shown above, but can be modified within the scope of the following claims. It will be appreciated, therefore, that the pressure sensor (70) need not necessarily be located in proximity to the gaseous phase, but may also be arranged anywhere adjacent to the oil phase part (68A). It will furthermore be appreciated that, by means of a top-up cylinder 69 and a pressure sensor 91, 92, it is possible to vary the quantity of gas inside the accumulator arrangement 6 as a function of the temperature. It is thus possible to top up with further gas before the machine is put into operation (or during a brief interruption), at a gas temperature (e.g. 0° C.) that is lower than the calibration temperature (e.g. +20° C.), so that precisely the required filling quantity, e.g. 75%, is obtained when the set-point pressure, e.g. 120 bar has been attained. If, on the other, the temperature increases above the calibration temperature, it is possible to do the opposite, that is to release a desired quantity of gas until the temperature sensor 95 and the pressure sensor 91 indicate that the desired level has been attained.

What is claimed is:

1. Mobile handling arrangement with hydraulic circuit, forming part of which hydraulic circuit (L) is a double-acting lifting cylinder (1) arranged in a lifting arrangement (100) made for handling a variable load together with an accumulator arrangement (6) for recovering and reusing the lowered load energy, together with a hydraulic pump (71) for topping up the said accumulator arrangement (6) with oil, the hydraulic circuit also comprising a variable hydraulic machine (3) having two ports, (10, 11), the said hydraulic machine being capable, by way of a drive unit (D), of delivering full system pressure in two directions of flow to the said ports, one port (11) being connected to the said accumulator arrangement (6) and the other port being connected to the said lifting cylinder (1), characterised in that the hydraulic circuit (L) comprises a temperature sensor (95) in connection with a gaseous phase part (68B) of the said accumulator arrangement (6) and a control and feedback unit (94) in communication with the said temperature sensor (95), by means of which the filling level of gas in the said accumulator arrangement (6) is adjusted as a function of the temperature in the said gaseous phase part (68B).

2. Mobile handing arrangement according to claim 1, characterised in that the said accumulator arrangement (6) comprises at least two vessels (68, 66A), one of the said vessels (66A) being connected solely to the gaseous phase part (68B).

3. Mobile handing arrangement according to claim 2, characterised in that the said further vessel (66A) comprises a standard container for top-up gas, the maximum pressure level for the said vessel exceeding 200 bar.

4. Mobile handing arrangement according to claim 2, characterised by a shut-off element (67) in a line between the said two vessels (68, 66A).

5. Mobile handing arrangement according to claim 2, characterised by a connection (64A) in order to permit the connection of a top-up cylinder (69) to the gaseous phase part (68B).

6. Mobile handing arrangement according to claim 1, characterised by at least one pressure sensor (91), which detects the pressure in the said accumulator arrangement (6).

7. Mobile handling arrangement with hydraulic circuit, which hydraulic circuit (L) comprises a double-acting lifting cylinder (1) arranged in a lifting arrangement (100) made for handling a variable load together with an accumulator arrangement (6) for recovering and reusing the lowered load energy, and a hydraulic pump (71) for topping up the said accumulator arrangement (6) with oil, the hydraulic circuit also comprising a variable hydraulic machine (3) having two ports, (10, 11), the said hydraulic machine being capable, by way of a drive unit (D), of delivering full system pressure in two directions of flow to the said ports, one port (11) being connected to the said accumulator arrangement (6) and the other port being connected to the said lifting cylinder (1), characterised in that the temperature in a gaseous phase part (68B) of the accumulator (6) is registered by means of a temperature sensor (95), that the said registered temperature level is processed by a feedback and control unit (94), which actuates the hydraulic pump (71) in order to fill the accumulator (6) with a charging pressure that varies as a function of the registered temperature.

8. Mobile handing arrangement according to claim 7, characterised in that the pressure inside the gaseous phase part (68B) is registered by means of a pressure sensor (91), and with the accumulator arrangement (6) filled is set by the feedback and control unit (94) so that it is 5–20% greater than the maximum hydraulic pressure of the hydraulic circuit (L).

9. Mobile handing arrangement according to claim 7, characterised in that at least one further vessel (66A) is arranged in connection with the gaseous phase part (68B) in a main accumulator of the said accumulator arrangement (6).

10. Mobile handing arrangement according to claim 9, characterised in that the connection between the said gas cylinder (66A) and the said main accumulator (68) is designed with a shut-off element (67), and that the main accumulator (68) is designed with a connection (64A), by way of which a top-up cylinder (69) is connected up and that the said accumulator (6) is topped up with gas from the said gas cylinder (69) by first filling the gaseous part (68B) in the main accumulator (68) with gas from the gas cylinder (69), with the shut-off element (67) closed, and then opening the shut-off element (67) and using the hydraulic pump (71) to force the quantity of gas inside the main accumulator (68) into the said gas cylinder (66A), and repeating the said process in order to obtain the desired quantity of gas inside the accumulator arrangement (6).

* * * * *